US005614059A

United States Patent [19]

Boriani et al.

[11] Patent Number: 5,614,059

[45] Date of Patent: Mar. 25, 1997

[54] DEVICE FOR SUPPORTING DISPENSERS OF ADHESIVE MATERIAL

[75] Inventors: Silvano Boriani; Alessandro Minarelli, both of Bologna, Italy

[73] Assignee: G.D S.p.A., Bologna, Italy

[21] Appl. No.: 266,695

[22] Filed: Jun. 28, 1994

[30] Foreign Application Priority Data

Jun. 28, 1993 [IT] Italy ..... BO93A0299

[51] Int. Cl.[6] ..... B65H 21/00

[52] U.S. Cl. ..... 156/509; 156/502; 118/242; 118/256; 118/705; 242/556

[58] Field of Search ..... 156/157, 159, 156/502, 504, 508, 509; 242/556; 118/242, 705, 706, 256

[56] References Cited

U.S. PATENT DOCUMENTS

| | | | |
|---|---|---|---|
| 1,437,348 | 11/1922 | Metzger | 156/508 |
| 2,518,927 | 8/1950 | Ordman et al. | 156/508 |
| 5,054,417 | 10/1991 | Bhatia et al. | 118/263 X |
| 5,287,806 | 2/1994 | Nanzai | 118/242 X |
| 5,385,622 | 1/1995 | Klingebiel | 156/157 |

FOREIGN PATENT DOCUMENTS

| | | | |
|---|---|---|---|
| 0274737 | 7/1988 | European Pat. Off. | B65H 21/00 |
| 2587982 | 4/1987 | France | 242/556 |

*Primary Examiner*—Mark A. Osele
*Attorney, Agent, or Firm*—Cushman Darby & Cushman IP Group of Pillsbury Madison & Sutro LLP

[57] ABSTRACT

In a device by means of which to support dispensers of adhesive material for application to selected areas of a wrapping material, use is made of a slide equipped with a yoke providing a releasable restraint for at least one disposable type of dispenser consisting of or containing the adhesive. The slide reciprocates between at least two limit positions, following a path along which the adhesive is applied by the dispenser to a selected area.

5 Claims, 3 Drawing Sheets

DEVICE FOR SUPPORTING DISPENSERS OF ADHESIVE MATERIAL

BACKGROUND OF THE INVENTION

The present invention relates to a device serving to support a dispenser of adhesive material. In automatic production machines, for example such as machines used in the manufacture of cigarettes, which operate utilizing strip material consisting typically of a continuous band of paper decoiled from a roll, the need arises periodically for one roll nearing depletion to be replaced with a new roll. The changeover must be effected with no break in continuity of the action by which the strip is fed to the point of use. In effect, a break in feed would translate ultimately into an interruption of the operating cycle of the machine as a whole.

To the end of overcoming this problem, machines of the type in question are equipped with automatic splicing devices capable of making a joint swiftly and faultlessly between the trailing end of a strip decoiling from one roll, near to depletion, and the leading end of a strip drawn from a new roll.

It is usually the case with such splicing devices that the leading end of the new roll of strip will be restrained, motionless, in a position ready to be brought into contact with the trailing end of the depleting roll; thereafter, at the appropriate moment, a splice is effected between the leading and trailing ends by suitable jointing means. Naturally, considerable importance attaches to the speed with which these splicing devices are able to operate; also, a fundamental role is played by the particular jointing means adopted: in effect, the jointing means must guarantee a secure bond during the brief moment when the leading end and trailing end are brought into contact, so that when the new strip is drawn forward by the depleted strip there will be no risk of the two becoming separated.

The jointing means obviously will differ according to the type of strip material utilized; in the case of a paper material, such means consist generally of lengths of adhesive tape, single-sided or double-sided stickers, and often an adhesive material of liquid or paste consistency directed to the point of use and applied in a convenient manner by suitable dispensing means. The use of stickers or lengths of adhesive tape dictates that the area of the bond between the leading end of the new strip and the trailing end of the depleted strip will be only of modest proportions, limited generally to a central part of the strips as considered in the transverse dimension. This can occasion an incorrect mutual alignment of the joined ends at the moment when the new strip is drawn forward by the depleted strip; with the lateral portions of the leading end of the new strip remaining unstuck, moreover, these same portions can fold back and inhibit the correct feed motion of the strip.

By contrast, the use of a liquid or paste adhesive affords the advantage of allowing a new strip and a depleting strip to be bonded together across the full width of the strip material, and thus avoiding drawbacks of the type in question. The glue must, however, be applied across the entire transverse dimension of the strip, swiftly and with precision. Known means for dispensing such adhesive materials are substantially of two types. In a first type, use is made of one or more nozzles connected via rigid or flexible small bore tubes to tanks containing the adhesive material.

A second type makes use of gumming rollers, which are dipped initially in the adhesive material and then positioned and rotated in such a manner as to coat a portion of the leading end of the new strip. The problems betrayed by these types of dispensers become evident whenever there is a need, as already intimated, for the adhesive material to be applied precisely, at high speed, and spread over areas of notable dimensions.

With this in mind, one may consider the requirement for precision and speed when the adhesive material in use is a fast-bonding type. Where a changeover of rolls is to be effected, the adhesive material must be applied to a relatively long portion of the strip, typically of a length substantially equivalent to the transverse dimension of the selfsame strip, and where the dispenser is installed, for example, in a machine for fashioning cigarette packets or multipack cartons, applied substantially along the full longitudinal dimension of the securing flaps exhibited by the corresponding cardboard die-cuts.

It is clear, therefore, that the problems involved in moving these nozzles and the respective feed tubes at a high velocity are not inconsiderable, given the inertia of the moving parts; and equally clear in the case of the rollers, moreover, that a clean and accurate gumming action becomes difficult to achieve, once certain operating speeds are exceeded.

Similarly evident is the limited flexibility of use afforded by such dispensers, which certainly are not able to respond to the different requirements typically encountered in manufacturing machines of the type in question.

SUMMARY OF THE INVENTION

The object of the present invention is to overcome the drawbacks mentioned above, and thus to enable a precise and clean application of any given adhesive material, at high speed.

The stated object is comprehensively realized in the device disclosed, of which the function is to support dispensers of adhesive material destined for application to areas or stretches of portions or flaps of wrapping material, each at a point close to or within the compass of a machine station equipped with jointing means designed to splice or otherwise secure the portions or flaps.

The device according to the invention comprises supporting and retaining means, embodied in such a way as to restrain at least one disposable-type dispenser of adhesive material, in a releasable manner, and capable of movement within the compass of the station between at least two first limit positions; the two limit positions are assumed by completing a forward stroke and a return stroke, during at least one of which the adhesive material is applied by the disposable dispenser to the areas or stretches of the portions or flaps of wrapping material.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
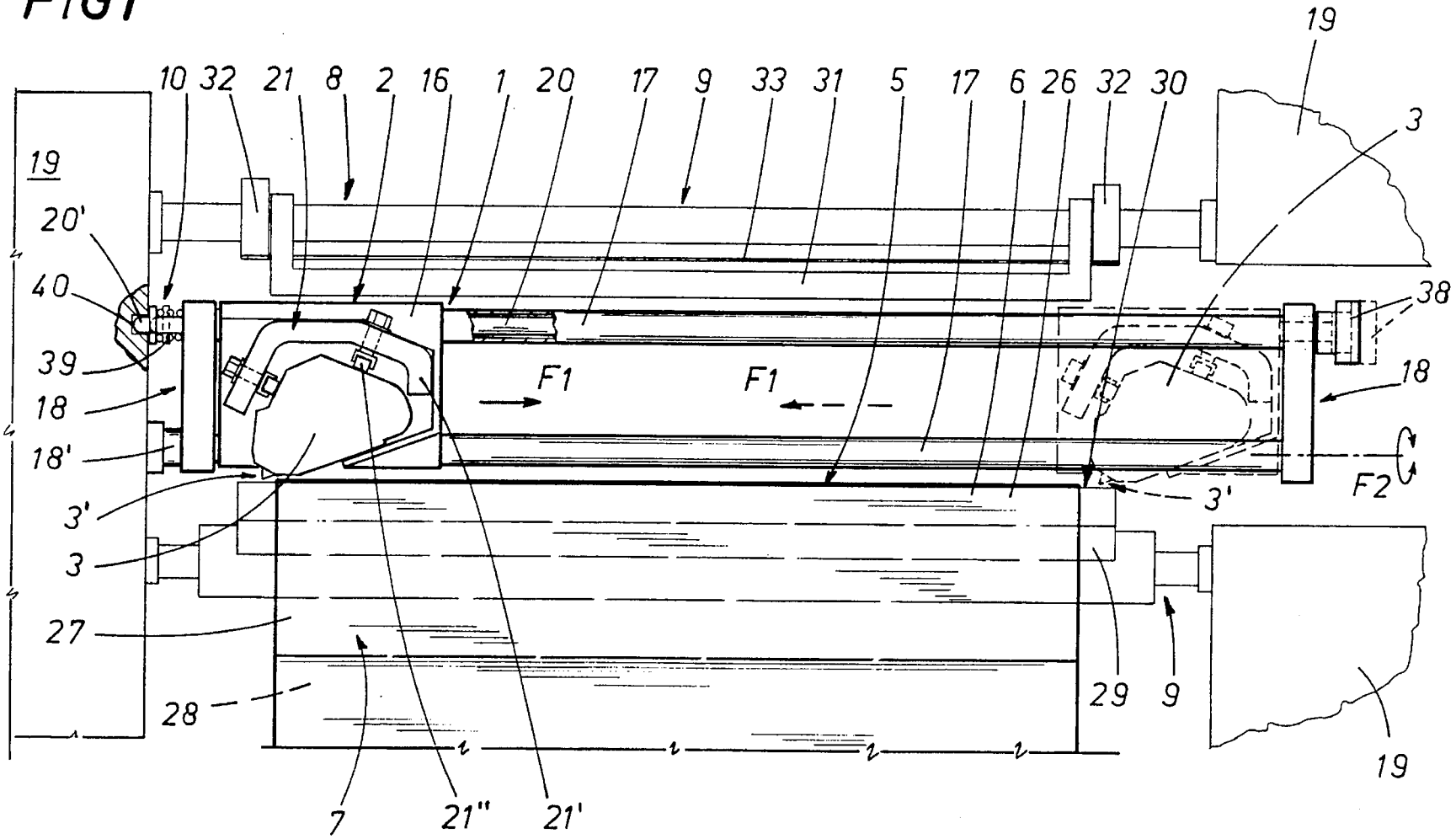
FIG. 1 is the schematic front elevation of a first embodiment of the support device according to the present invention.

With reference to the accompanying drawings, the invention relates to a device, denoted 1 in its entirety, serving to support dispensers of adhesive material. The device 1 comprises supporting and retaining means 2 embodied and structured in such a way as to restrain and support at least one unit, denoted 3 which is, capable of dispensing adhesive material. The unit 3 in question is self-contained, insofar as it is not supplied from an external source, and, in practice, consists of a dispenser 3 of disposable type.

As already intimated in the preamble to the present specification, the support device 1 disclosed forms part of a dispensing unit of which the function is to apply adhesive material to areas or stretches 5 of portions or flaps 6 of a wrapping material 7, in such a way, for example, as will allow of bonding two connected ends of a wrapping material procured in continuous strip format. As is evident from the description and drawings, the term "continuous" as used herein, does not means endless, as a hoop is continuous, but does means of indeterminate length, i.e., so long that it seems to be continuous.

Figure 2:
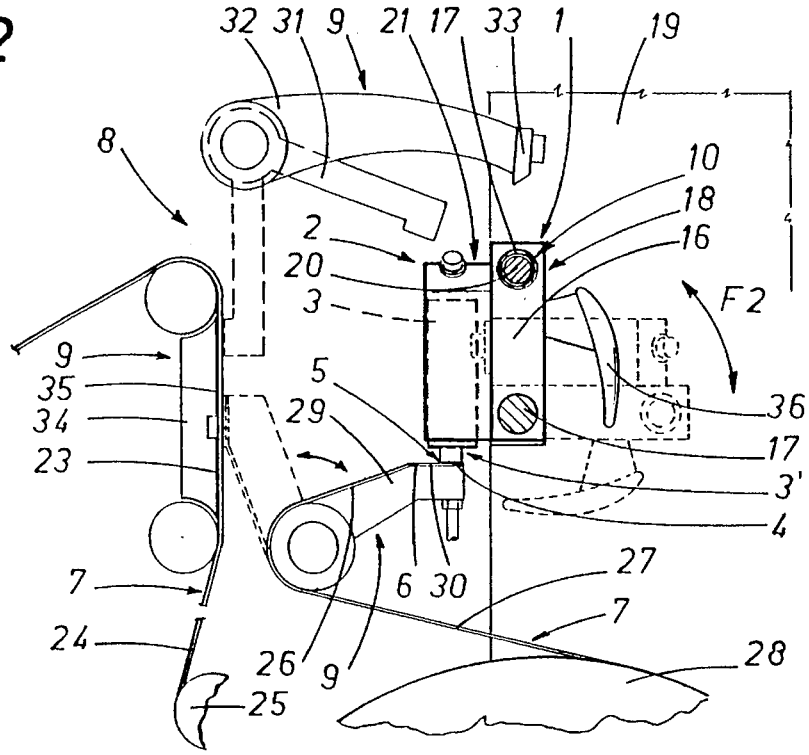
FIG. 2 is a schematic side elevation of the device of FIG. 1.

Observing FIGS. 1 and 2, the device 1 is illustrated, by way of example, disposed and operating within the compass of a station 8 forming part of a production machine of which, in the interests of simplicity, only certain parts of the bed 19 are discernible; the station 8 is equipped with jointing means 9 by which the aforementioned areas or stretches 5 of portions or flaps 6 of the wrapping material 7 are brought mutually into contact and bonded together. In particular, the jointing means 9 as illustrated in FIGS. 1 and 2 are designed to bring the trailing end 23 of one strip 24 of paper material, decoiling from a roll 25 feeding continuously to the machine and, near depletion, into overlapping contact with the leading end 26 of a second strip 27 lifted from a new roll 28 and positioned in contact with the surface 30 of a suction bar 29 forming part of the selfsame jointing means 9. Other components of the jointing means 9 include a plate 34 having a locating surface 35, over which the depleting strip 24 runs during normal operation, a rail or bar 31 by which the trailing end 23 of the depleting strip 24 is immobilized and restrained, and a pair of arms 32 carrying a blade 33 by which a terminal portion of the trailing end 23 is trimmed off once a join has been made. Briefly, the jointing means 9 operate thus: at a given moment, the trailing end 23 of the depleting strip 24 is pinned by the bar 31 against the locating surface 35 of the plate 34, whereupon the surface 30 of the suction bar 29 is brought, together with the already positioned and restrained leading end 26 of the new strip 27, into contact with the trailing end 23 and held forcibly against the locating surface 35 (the configuration shown by phantom lines in FIG. 2).

As indicated in FIG. 1, the supporting and retaining means 2 are capable of movement transversely across the new strip 27, in the directions of the arrows denoted F1, between two first limit positions which compass the full transverse dimension of the strip 27.

Accordingly, the dispenser 3 is able to apply the adhesive material 4 across the entire width of the relative portion 6 afforded by the leading end 26 of the new strip 27. In the example of FIGS. 1 and 2 the adhesive material applied with the disposable dispenser 3 is of a paste consistency.

To enable their traversing movement between the two first limit positions, the supporting and retaining means 2 comprise a slide 16 which is free to travel along a pair of tubular ways 17 carried by a frame 18. The slide 16 is also equipped with respective retaining means 21, by which the disposable dispenser 3 can be restrained in releasable fashion. Such means 21 are designed to allow a rapid substitution for the spent dispenser 3 by a new replacement, and, in certain instances, as will become clear in due course, are supported movably by the slide 16.

The slide 16 can be traversed manually between the first two limit positions by operating a handle denoted 36, as in the example of FIGS. 1 and 2, or automatically through the agency of first actuating means 12, as in the examples of FIGS. 3, 4, 5 and 6. These latter solutions are well suited, clearly enough, to applications in which the device 1 is required to operate at high speed. As discernible in FIGS. 3, 4, 5 and 6, first actuating means might consist, for example, in a pneumatically operated slide 16' which is capable of movement automatically along respective tubular ways 22 carried by a structure, which is supported in its turn, by the frame 18.

Figure 5:
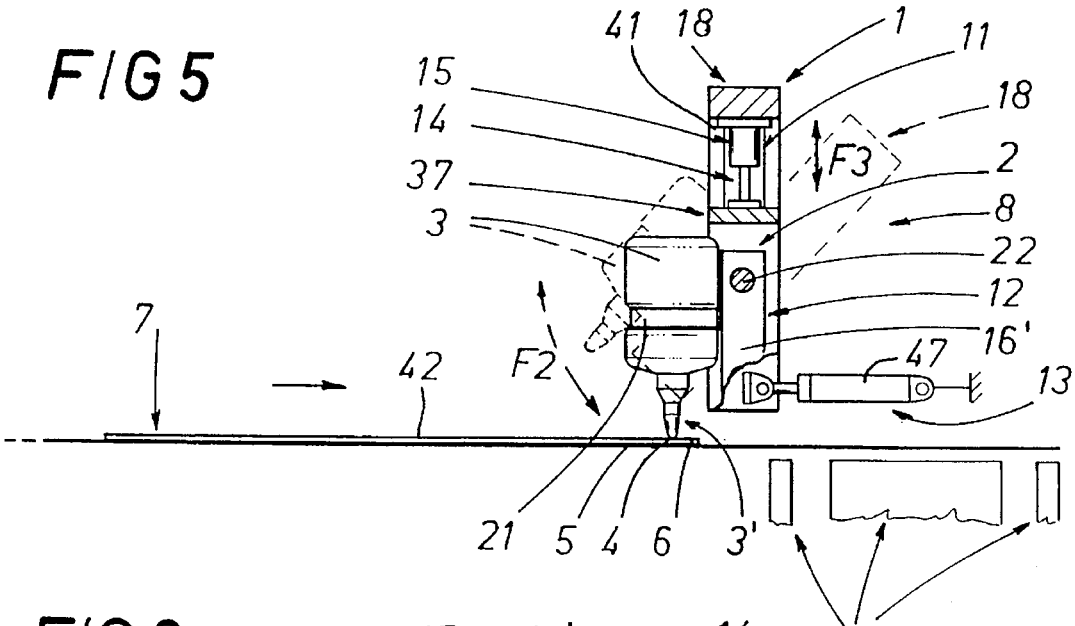
FIG. 5 is a schematic side elevation of the device as in FIG. 4, illustrated with certain parts omitted better to reveal others.

The frame 18 is associated with the machine bed 19 by way of a pivot 18', and can be rotated thus about the axis of the pivot 18' in the directions of the arrow denoted F2; accordingly, the supporting and retaining means 2, with the dispenser 3, are able to alternate between two second limit positions in which the means 2 are disposed respectively close to the jointing means 9, and at a distance such as will ensure that the operating movements of the selfsame jointing means 9 are not obstructed (see FIGS. 2 and 5). The frame 18 is rotatable between the two second limit positions through the agency of second actuating means 13, as will shortly be described.

Figure 3:
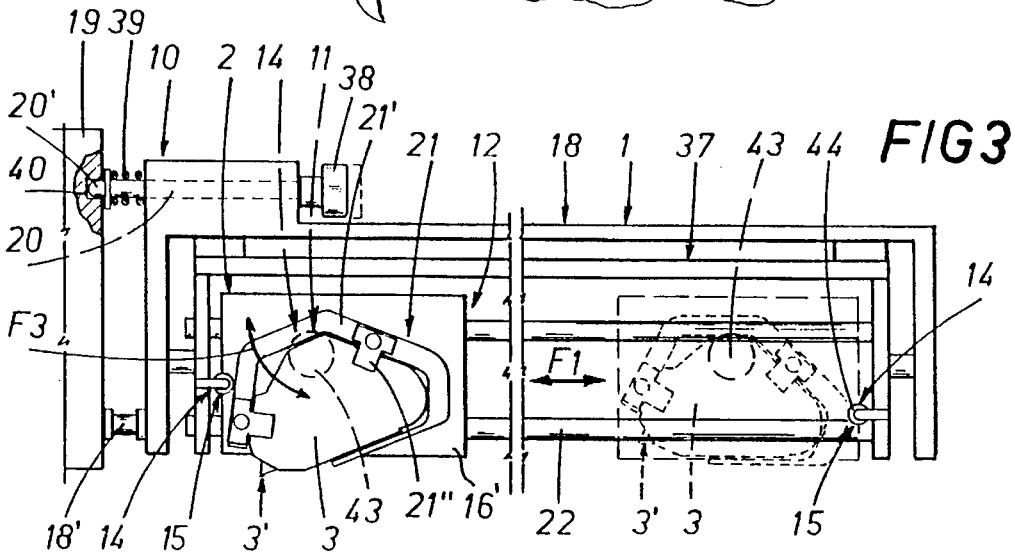
FIG. 3 illustrates an alternative embodiment of the device of FIG. 1, seen in a front elevation.

In order to ensure the stability of the supporting and retaining means 2 at both of the second limit positions, the device 1 comprises first releasable locking and positioning means 10. As illustrated in FIGS. 1 and 3, such means 10 consist of a rod 20 capable of axial movement internally of the tubular way 17 uppermost. The opposite ends of the rod 20 emerging from the tube 17 are fitted respectively with a bolt 20' and with a knob 38, The bolt 20' is tensioned by a spring 39 and stably insertable thus in respective sockets 40 afforded by the bed 19 of the machine, which are located to coincide with the two second limit positions. To free the bolt 20' from the socket 40, it suffices to take hold of the knob 38 and draw the rod back, thereby compressing the tension spring 39.

Figure 4:
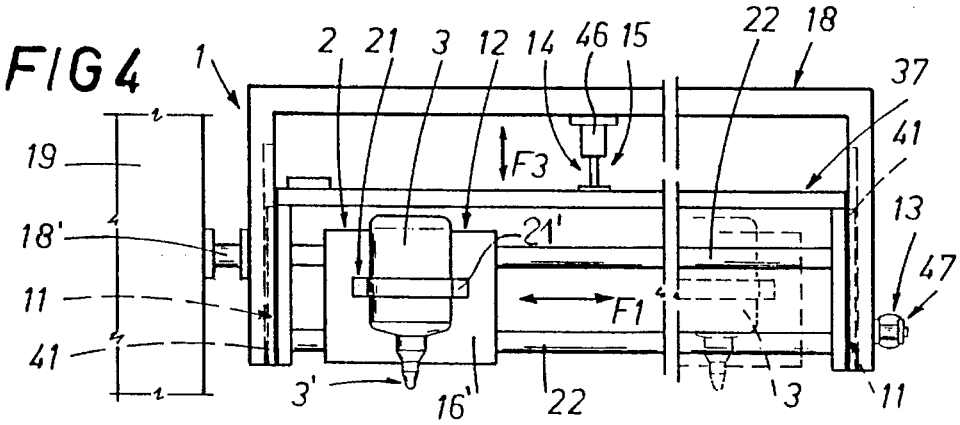
FIG. 4 illustrates a further alternative embodiment of the device of FIGS. 1 and 3, seen in a schematic front elevation.

As discernible in FIGS. 3, 4 and 5, the supporting and retaining means 2 are able to move between two third limit positions, in the directions indicated by the arrow denoted F3. This same movement between third limit positions allows the dispenser 3 and the respective applicator 3' to alternate between a position of contact with the areas or stretches 5 of portions or flaps 6 of the wrapping material 7, in which the adhesive material 4 is applied, and a position which is distanced from the wrapping material 7.

Figure 6:
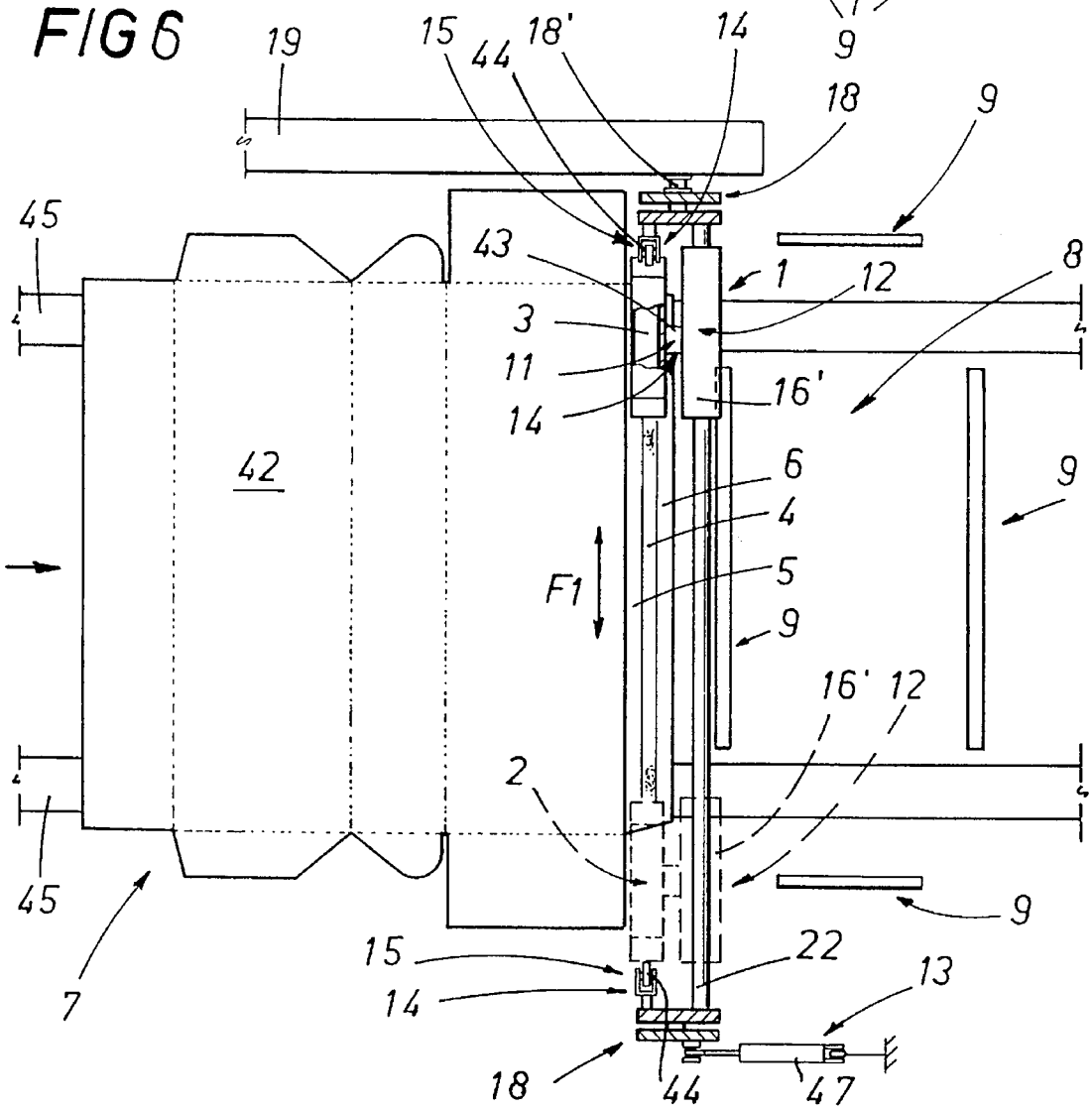
FIG. 6 is a schematic plan view of the device shown in FIGS. 4 and 5, utilized to support a dispenser from which adhesive material is applied to portions of die-cuts as used, by way of example, to fashion cartons for packets of cigarettes.

In the examples illustrated in FIGS. 3, 4, 5 and 6, the dispenser 3 is moved between the third limit positions with the aid of second releasable locking and positioning means 11 operating in conjunction with respective actuator means 15. In FIGS. 3 and 6, in particular, such second locking and positioning means 11 consist of a conventional catch mechanism of reversible type, denoted 43, allowing two stable angular positions, by which the dispenser retaining means 21 and the pneumatically operated slide 16' are interconnected.

The retaining means 21 illustrated in FIGS. 1 to 3 are associated with a dispenser 3 designed to apply an adhesive material 4 of paste consistency, and appear as a yoke 21' fashioned in such a manner as to restrain the dispenser 3 by way of respective releasable fastening means 21", conventional in embodiment. The aforementioned catch mechanism 43, likewise conventional, allows a moving element to locate in one or the other of two stable angular limit positions. The mechanism 43 must be rotated to move the element from one position to the other, applying a torsional force sufficient to overcome an opposing torque. In the case of FIGS. 3 to 6, the catch mechanism 43 operates in conjunction with a pair of fixed position rollers 44 connected to a structure denoted 37 and constituting the actuator means 15, the yoke 21' being intercepted by the rollers 44 as the pneumatically operated slide 16' traverses along the ways 22 toward the two first limit positions. Each time the slide 16' approaches its travel limit in either direction, the yoke 21' engages the respective roller 44, and is constrained to rotate, such that the catch mechanism 43 must also rotate as indicated by the arrow F3 (FIG. 3), in the direction counter to the linear direction of the slide 16': thus, depending on the position and movement of the slide, the catch mechanism 43 is forced to assume one of two angular limit positions corresponding to the third limit positions of the dispenser 3. In this instance, the second locking and positioning means 11 and the rollers 44 may be regarded jointly as third actuating means 14, so that the second locking and positioning means 11, the third actuating means 14 and the aforementioned actuator means 15 are essentially one and the same. In the examples of FIGS. 4 and 5, the structure 37 is supported by the frame 18 and capable thus of movement along a pair of prismatic guides 41, which constitute the aforementioned releasable locking and positioning means 11. This same movement of the structure 37 in relation to the frame 18 is brought about through the agency of respective actuating means 14 and actuator means 15, which, again, are one and the same and might consist, for example, of a pneumatic cylinder 46. Accordingly, the dispenser 3 of FIGS. 4 and 5, which consists of a container of liquid adhesive material 4, such as a quick-setting glue, is made to alternate between the third limit positions by actuating the pneumatic cylinder 46 to traverse the structure 37 relative to the frame 18. In this instance, the retaining means 21 consist of a clip 21" fastened around and removable from the dispenser 3.

FIG. 6 illustrates a solution in which the wrapping material 7 consists of a succession of die-cuts 42 supported by and advanced toward the device 1 on power-driven feed belts 45. In this instance, the dispenser 3 will apply the adhesive material 4 to one stretch 5 of a portion 6 which might be, for example, a flap of the die-cut 42.

In the solutions of FIGS. 4, 5 and 6, the frame 18 is traversed between the two second limit positions by the second actuating means 13, which are shown as pneumatic cylinders 47 in the particular examples illustrated.

The operation of the device 1 is easily discernible in the light of the foregoing description.

In the event that the slide 16 is operated by hand (FIGS. 1 and 2), the sequence will be as follows: with the frame 18 motionless in the position of the bold lines in FIG. 2, and the leading end 26 of the new strip 27 restrained on the suction bar 29, the supporting and retaining means 2 occupy the second limit position, whereby the dispenser 3 is poised with the applicator 3' offered to the strip 27. When the moment arrives for the adhesive material 4 to be applied, the operator takes hold of the handle 36 and traverses the slide 16 between the two first limit positions. More exactly, the slide is traversed once in the forward direction (from left to right in FIG. 1) to apply the adhesive material 4 to the strip 27, whereupon the first locking and positioning means 10 are released; the frame 18 is then rotated about the pivot 18' and the slide 16 returned in the opposite direction.

With the frame 18 able thus to alternate between the two second limit positions, its translational movement between the two first limit positions is rendered such that the dispenser 3 can effect an active forward stroke in which contact is made with the wrapping material 7, and a non-active return stroke in which no adhesive material 4 is released, hence without any need to employ the third limit positions. Adopting this solution, moreover, the suction bar 29, restraint bar 31 and blade 33 are able to move freely toward the locating surface 35. The operation of the device 1 in the embodiment with the pneumatically operated slide 16' remains essentially the same as described above. With the dispenser 3 in this instance capable additionally of movement between third limit positions, brought about by second locking and positioning means 11 and automatic actuating and actuator means 14 and 15, the various operating steps can be effected in notably quick time. In the example of FIGS. 4 and 5, for instance, the pneumatically operated slide 16' is traversed with speed and precision (arrow F1) along the tubular ways 22 between the first limit positions, accomplishing a first stroke (whether extending or returning) in which the dispenser 3 applies the adhesive material 4, and a non-active stroke that can follow immediately in the opposite direction, since the dispenser 3 will already have been raised by the pneumatic cylinder to the third limit position in which the applicator 3' remains distanced from the stretch 5 of wrapping material.

We claim:

1. A device for supporting dispensers of an adhesive material to be applied to areas or stretches of portions or flaps of wrapping material at a point close to or within the compass of a machine station occupied by respective jointing means positioned to interact with the portions or flaps, comprising:

supporting and retaining means embodied in such a way as to support and retain at least one disposable dispenser of adhesive material in releasable manner and capable of movement within the compass of said station between at least two first limit positions respectively assumed by completing a forward stroke and a return stroke, during at least one of which the adhesive material is applied, by an applicator associated with the disposable dispenser, to the areas or stretches of the portions or flaps of wrapping material;

first releasable locking and positioning means;

said supporting and retaining means being capable of movement within the compass of said station between two second limit positions, disposed close to said jointing means in one such position so as to allow effecting at least one stroke during which said adhesive material is applied by said applicator associated with said disposable dispenser, and distanced from said jointing means in a remaining said position, and interacting throughout with said first releasable locking and positioning means to ensure stability in both of the second limit positions thus assumed;

second releasable locking and positioning means, and respective supporting and retaining means activating means effectively associated therewith;

said supporting and retaining means being capable of movement within the compass of said station between two third limit positions including a position in which the applicator associated with the disposable dispenser is brought into contact with the areas or stretches of portions or flaps of wrapping material in order to effect at least one stroke during which the adhesive material is applied, and a position in which the applicator associated with the disposable dispenser is distanced from the areas or stretches by said supporting and retaining means, interacting throughout with said second releasable locking and positioning means operated by said respective actuating means to ensure the stability of the disposable dispenser in said third limit positions.

2. A device for supporting dispensers of an adhesive material to be applied to areas or stretches of portions or flaps of wrapping material at a point close to or within the compass of a machine station occupied by respective jointing means positioned to interact with the portions or flaps, comprising:

supporting and retaining means embodied in such a way as to support and retain at least one disposable dispenser of adhesive material in releasable manner and capable of movement within the compass of said station between at least two first limit positions respectively assumed by completing a forward stroke and a return stroke, during at least one of which the adhesive material is applied, by an applicator associated with the disposable dispenser, to the areas or stretches of the portions or flaps of wrapping material;

first releasable locking and positioning means;

said supporting and retaining means being capable of movement within the compass of said station between two second limit positions, disposed close to said jointing means in one such position so as to allow effecting at least one stroke during which said adhesive material is applied by said applicator associated with said disposable dispenser, and distanced from said jointing means in a remaining said position, and interacting throughout with said first releasable locking and positioning means to ensure stability in both of the second limit positions thus assumed;

second releasable locking and positioning means, and respective supporting and retaining means activating means effectively associated therewith;

a fixed bed for a machine having said machine station;

said supporting and retaining means including a slide which is capable of movement along two mutually parallel tubular ways carried by a structure supported in a frame which occupies a position of alignment with the areas or stretches of portions or flaps of wrapping material and is hinged to said fixed bed of said machine by way of a pivot in such a way as to rotate in a direction transverse to the direction of movement of the slide between two angular limit positions coinciding with said two second limit positions.

3. A device as in claim 2, wherein:

said slide is equipped with respective releasable retaining means serving to restrain the disposable dispenser and rendered capable of motion in relation to said slide by said second releasable locking and positioning means operating in conjunction with said respective actuator means such as cause the disposable dispenser to alternate between and stably occupy two third limit positions in which said applicator is respectively disposed in contact with and distanced from the stretches or areas of portions or flaps of wrapping material.

4. A device as in claim 3, further including a frame supporting said supporting and retaining means with freedom of movement afforded by a pair of prismatic guides constituting said second releasable locking and positioning means and set in motion by said supporting and retaining means actuating means such as cause said supporting and retaining means to alternate between and stably occupy said two third limit positions.

5. A device as in claim 2, wherein:

said slide is a pneumatically operated slide capable of movement along respective said tubular ways and constituting first actuating means by which said supporting and retaining means are controlled and set in motion.

* * * * *